US006558270B2

(12) United States Patent
Kwitek

(10) Patent No.: US 6,558,270 B2
(45) Date of Patent: May 6, 2003

(54) GRIP

(76) Inventor: Benjamin J. Kwitek, 1061 Valley View Dr., Canon City, CO (US) 81212

( * ) Notice: Subject to any disclaimer, the term of this patent is extended or adjusted under 35 U.S.C. 154(b) by 0 days.

(21) Appl. No.: 09/900,977

(22) Filed: Jul. 10, 2001

(65) Prior Publication Data

US 2001/0055994 A1 Dec. 27, 2001

Related U.S. Application Data

(63) Continuation-in-part of application No. 09/173,445, filed on Oct. 16, 1998.

(60) Provisional application No. 60/217,028, filed on Jul. 11, 2000, and provisional application No. 60/062,215, filed on Oct. 16, 1997.

(51) Int. Cl.[7] ..... A63B 53/14

(52) U.S. Cl. ..... 473/301; 473/549; 473/568; 280/821; 74/551.9; 81/489

(58) Field of Search ..... 473/300–304, 473/549–552, 568; 74/551.9; 81/489; 280/821

(56) References Cited

U.S. PATENT DOCUMENTS

| | | | | |
|---|---|---|---|---|
| 584,220 | A | | 6/1897 | Gunsaul |
| 1,469,766 | A | | 10/1923 | Blair ..... 473/549 |
| 1,940,104 | A | * | 12/1933 | Russel |
| 4,221,382 | A | | 9/1980 | Cooper et al. ..... 273/73 F |
| 4,785,495 | A | | 11/1988 | Dellis ..... 16/111 R |
| 4,871,004 | A | * | 10/1989 | Brown et al. ..... 152/209.4 |
| 4,953,861 | A | | 9/1990 | Nakanishi ..... 273/76 J |
| 4,998,367 | A | | 3/1991 | Leibowitz ..... 42/71.02 |
| 5,000,599 | A | | 3/1991 | McCall et al. ..... 401/6 |
| 5,042,804 | A | * | 8/1991 | Uke |
| 5,146,628 | A | | 9/1992 | Herrmann et al. ..... 2/161 R |
| 5,197,732 | A | | 3/1993 | Lanctot ..... 273/73 R |
| D338,915 | S | | 8/1993 | Willat ..... D19/51 |
| 5,238,620 | A | * | 8/1993 | Wu |
| 5,269,284 | A | | 12/1993 | Pujos et al. ..... 124/88 |
| 5,294,119 | A | | 3/1994 | Vincent et al. ..... 273/80 B |
| 5,322,290 | A | | 6/1994 | Minami ..... 273/187.5 |
| 5,435,549 | A | | 7/1995 | Chen ..... 273/75 |
| 5,555,584 | A | | 9/1996 | Moore, III et al. ..... 12/142 N |
| 5,571,050 | A | | 11/1996 | Huang ..... 473/300 |
| 5,653,643 | A | | 8/1997 | Falone et al. ..... 473/300 |
| 5,730,669 | A | | 3/1998 | Huang ..... 473/549 |
| 5,759,113 | A | * | 6/1998 | Lai |
| 6,036,610 | A | | 3/2000 | Lewark ..... 473/564 |
| 6,068,922 | A | * | 5/2000 | Vercesi |
| 6,298,516 | B1 | * | 10/2001 | Beals |

FOREIGN PATENT DOCUMENTS

| | | |
|---|---|---|
| JP | 64-49579 | 2/1989 |

* cited by examiner

*Primary Examiner*—Stephen Blau
(74) *Attorney, Agent, or Firm*—Welsh & Flaxman LLC

(57) ABSTRACT

A grip adapted for attachment to an implement including a handle is disclosed. The grip includes a longitudinally extending tubular shell having an inner surface shaped and dimensioned for attachment to the handle of the implement and an outer surface. The grip further includes a viscoelastic hand surface secured about the outer surface of the tubular shell.

10 Claims, 3 Drawing Sheets

GRIP

CROSS-REFERENCE TO RELATED APPLICATIONS

This U.S. Patent Application is based upon U.S. Provisional Patent Application Ser. No. 60/217,028, filed Jul. 11, 2000, and entitled "GRIP", which is a continuation in part of U.S. patent application Ser. No. 09/173,445, filed Oct. 16, 1998, and entitled "GOLF GRIP", which is based upon U.S. Provisional Patent Application Ser. No. 60/062,215, filed Oct. 16, 1997, and entitled "GOLF GRIP".

BACKGROUND OF THE INVENTION

1. Field of the Invention

The invention relates to grips. More particularly, the invention relates to conformable grips formed with KEVLAR reinforced thermoplastics. In addition, the invention relates to the KEVLAR, aramid fiber, reinforced thermoplastics used in the manufacture of the grips discussed below. While the present grip technology was developed with the needs of golfers in mind, the present grip technology may be used with other sports implements, such as, tennis racquets and other racquets, baseball bats, fishing poles, sports equipment, hand tools, power tools and other industrial/commercial equipment.

2. Description of the Prior Art

The manner in which a golfer grips a golf club is critical to properly striking a golf ball. As such, many attempts have been made to provide golfers with an ideal golf grip.

For example, golf grips are commonly made from molded rubber materials or by wrapping a leather strap about the proximal end of the golf club. Grips such as these are generally tough on a golfer's hands. The problems associated with hard grips become even more pronounced when a golfer strikes hundreds of golf balls at a driving range, due to the continuous pressure applied by the golfer as he or she grips the golf club and strikes the golf ball.

In addition to being tough on the hands of golfers, these grips do not conform to the hands of individual golfers. Since each golfer's hands have unique pressure points, the use of identical grips for all golfers does not provide golfers with the custom feel they desire and deserve.

Prior attempts have been made to improve the hard grips commonly employed on sports implements and other tools. However, these grips have been met with only limited success, since they are often difficult to manufacture and use. For example, various wraps have been designed to cushion the hard hand surfaces found on many sports implements. While these wraps have met with some success, they are often difficult to use and provide individuals with a grip very different from the one to which they are accustomed. That is, these wraps generally change the size and texture of the grip to which they are applied. In addition, previous grips have usually been constructed of less advanced materials, such as, rubber or leather.

The use of thermoplastics in the manufacture of grips has been limited by the materials available. Specifically, until now, there has been a trade-off between soft and strong thermoplastic materials which may be utilized in the manufacture of grips. The softer a thermoplastic is made, the less resilient and durable it becomes. As such, where a grip might require a softer thermoplastic, its durability and strength become a limitation in the manufacture of a functional grip. As such, prior to the present invention, it was not possible to manufacture a soft, durable and strong grip providing individuals with an ergonomic feel.

A need, therefore, exists for a grip providing individuals with a soft and individually conforming hand surface with the necessary strength and durability. The present invention provides such a grip, as well as a material from which to make the grip.

SUMMARY OF THE INVENTION

It is, therefore, an object of the present invention to provide a grip adapted for attachment to an implement including a handle. The grip includes a longitudinally extending tubular shell having an inner surface shaped and dimensioned for attachment to the handle of the implement and an outer surface shaped and dimensioned to be gripped by an individual. The longitudinally extending tubular shell is made from a viscoelastic solid-phase polymer material composed aramid fibers dispersed within a thermoplastic elastomer.

It is also an object of the present invention to provide a grip wherein the aramid fibers are fibrillated and chopped.

It is another object of the present invention to provide a grip wherein the longitudinally extending tubular shell is shaped and dimensioned for use as a golf club grip.

It is a further object of the present invention to provide a grip wherein the thermoplastic elastomer is a styrenic thermoplastic elastomer.

It is yet another object of the present invention to provide a grip wherein the thermoplastic elastomer is EVA.

It is also an object of the present invention to provide a grip wherein the viscoelastic solid-phase polymer material has a Shore A Durometer of approximately 5 to 60.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
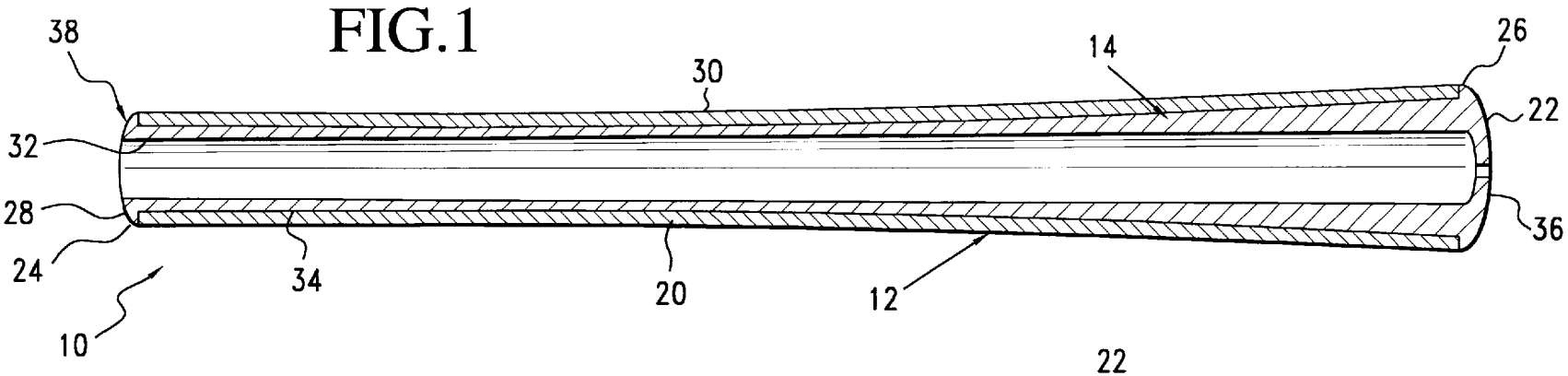
FIG. 1 is a cross-sectional view of the present grip.
Figure 2:
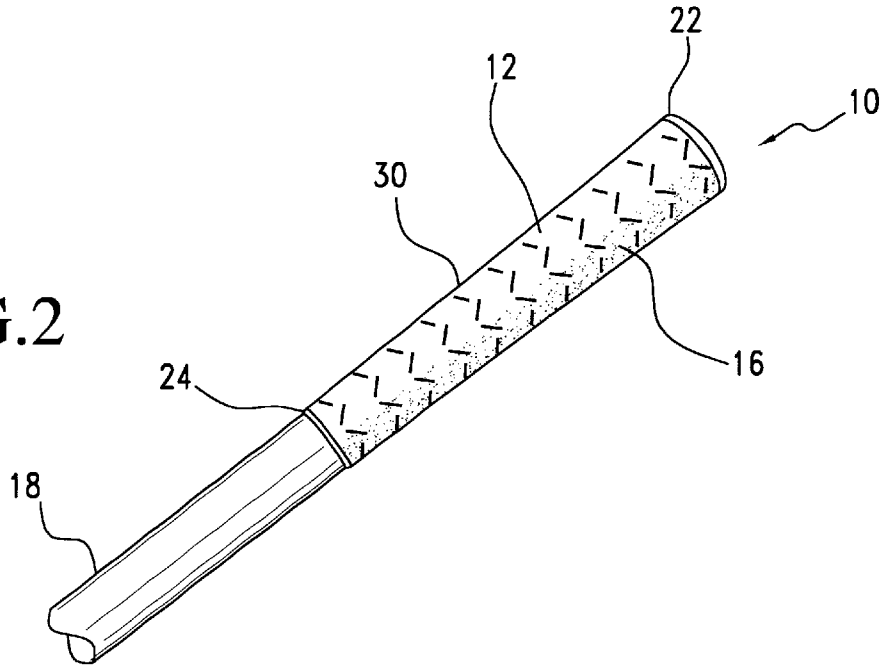
FIG. 2 is a perspective view of the present grip.
Figure 3:
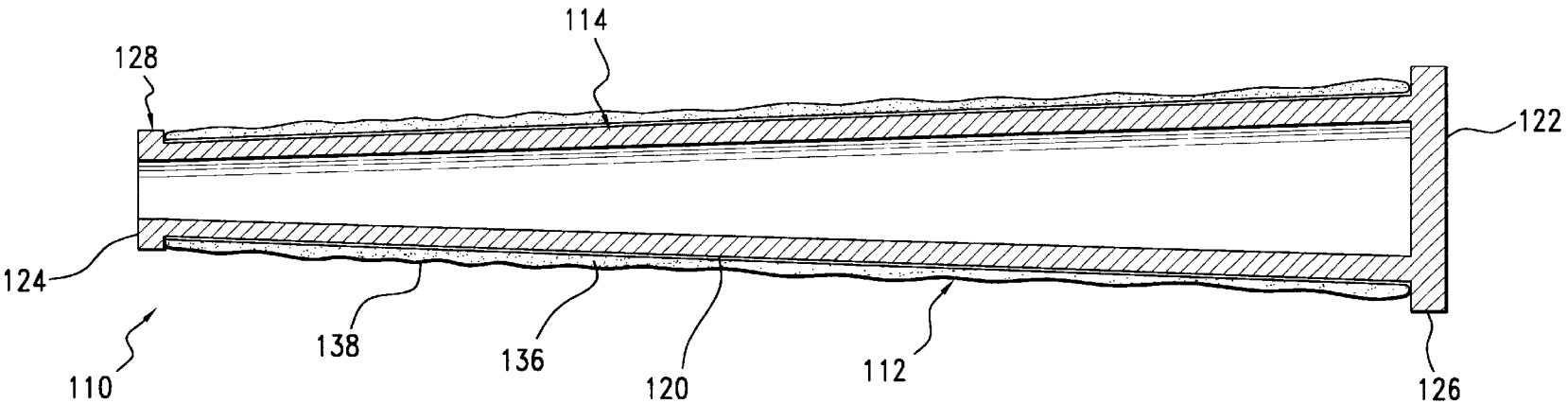
FIG. 3 is a cross sectional view of an alternate embodiment in accordance with the present invention.

With reference to FIGS. 1, 2 and 3, a golf grip 10, 110 is disclosed. The golf grip 10, 110 is designed with a responsive and relatively viscoelastic hand surface 12, 112. The viscoelastic hand surface 12, 112 provides golfers with a soft and individually conforming hand surface. For example, the viscoelastic hand surface 12, 112 may be a responsive and relatively viscoelastic solid-phase polymer material (FIGS. 1 and 2) or a gelatinous material interposed within a more resilient material to contain the gelatinous material (FIG. 3).

The hand surface of the present grip is an ultra-soft material. This endows the product with an inherent tactile feel. The grip, as described herein, provides a tacky surface, essential and beneficial for gripping. The tack level may be adjusted by chemical variations and/or treatment. In this way, desired final use characteristics may be accommodated. The ultra-soft hand surface can be measured in terms of hardness by the Shore A Durometer Test. The present grips have durometers in this scale between approximately 2 and 40.

In accordance with a preferred embodiment of the present golf grip 10, and with reference to FIGS. 1 and 2, the golf grip 10 includes a shell 14 shaped and dimensioned to fit about the proximal end 16 of a golf club shaft 18. As such, the shell 14 includes an inner surface 32 shaped and dimensioned to fit about the golf club shaft. The outer surface 34 of the shell 14 is shaped and dimensioned to receive the viscoelastic hand surface 12 in a manner that will be discussed in greater detail below.

As with most golf grips, the present golf grip 10, and the shell 14, are tapered as they extend from the closed proximal end 36 to the open distal end 38. This allows the shell 14 to conform to the shape of conventional golf club shafts 18.

The shell 14 may be constructed from a variety of soft elastomers, such as, rubber or synthetic rubber-like materials. However, other materials may be employed without departing from the spirit of the present invention.

The shell 14 includes a central section 20 about which the viscoelastic hand surface 12 is positioned. The proximal end 22 and distal end 24 of the shell 14 are respectively provided with lips 26, 28 circumferentially extending about the shell 14. The lips 26, 28 are shaped and dimensioned to retain the viscoelastic hand surface 12 about the central section 20 of the shell 14.

In accordance with the embodiment disclosed in FIGS. 1 and 2, the viscoelastic hand surface 12 is preferably a viscoelastic solid-phase polymer material. The viscoelastic solid-phase polymer material is preferably a styrenic thermoplastic elastomer containing, for example, KRATON, which is manufactured by Shell Chemical Company.

The viscoelastic hand surface 12 is positioned about the shell 14, and between the proximal and distal lips 26, 28. The viscoelastic hand surface 12 is preferably adhered to the central section 20 of the shell 14 with an adhesive. It is also contemplated that the hand surface 12 may be adhered to the central section 20 of the shell 14 by over-molding or co-molding. With related materials over-molding would create a chemical bond, in essence forging one piece containing assimilated parts. As those of ordinary skill in the art will certainly appreciate, other methods for securing the hand surface 12 to the shell 14 may be employed without departing from the spirit of present invention. Where the viscoelastic hand surface 12 is formed from a responsive, and relatively viscoelastic solid-phase polymer material, the outer surface 30 of the viscoelastic hand surface 12 is formed from the same viscoelastic material as the remainder of the hand surface 12.

An alternate embodiment of the present invention is disclosed in FIG. 3. The alternate embodiment is substantially similar to the embodiment described above with reference to FIGS. 1 and 2, but replaces the viscoelastic solid-phase polymer construction with a viscous liquid/gelatinous material contained in an elastomeric bag.

Specifically, the golf grip 110 includes a shell 114 shaped and dimensioned to fit about the proximal end of a golf club shaft. As with the prior embodiment, the shell 114 includes a central section 120 about which the soft viscoelastic hand surface 112 is positioned. The proximal and distal ends 122, 124 of the shell 114 are respectively provided with lips 126, 128. The lips 126, 128 are shaped and dimensioned to retain the soft polymer material forming the hand surface 112 about the central section 120 of the shell 114.

In accordance with the embodiment disclosed in FIG. 3, the viscoelastic hand surface 112 is a viscous liquid material 136 contained in an elastomeric bag 138. The viscous liquid 136 is preferably a silicone gel or oil and the elastomeric bag 138 is preferably a silicone sheet or a thermoplastic elastomer. While preferred materials are disclosed above, other materials exhibiting similar properties may be used without departing from the spirit of the present invention.

The viscoelastic hand surface 112 is preferably adhered to the central section 120 of the shell 114 with an adhesive. The attachment could also be accomplished by compressing both ends of the elastomeric bag 138 at the proximal and distal lips 126, 128 with a chamber and gasket system. As those of ordinary skill in the art will certainly appreciate, other methods for securing the viscoelastic hand surface 112 to the shell 114 may be employed without departing from the spirit of present invention.

The present golf grip 10, 110 is designed such that it may be placed about the proximal end of the golf club shaft in much the same manner that conventional golf grips are placed about the proximal end of a golf club shaft. As such, the present golf grip 10, 110 may be used as a replacement grip for worn grips or grips placed upon a golf club during the manufacture of the golf club.

In accordance with the preferred embodiments of the present invention, the soft polymer material forming the hand surface 12, 112 is approximately 1/16" –1/4" thick and the elastomeric shell 14, 114 may be less than 1/8" thick, but up to 1/4" thick. In this way, the present grip 10, 110 has substantially the same dimensions as conventional golf grips.

Figure 4:
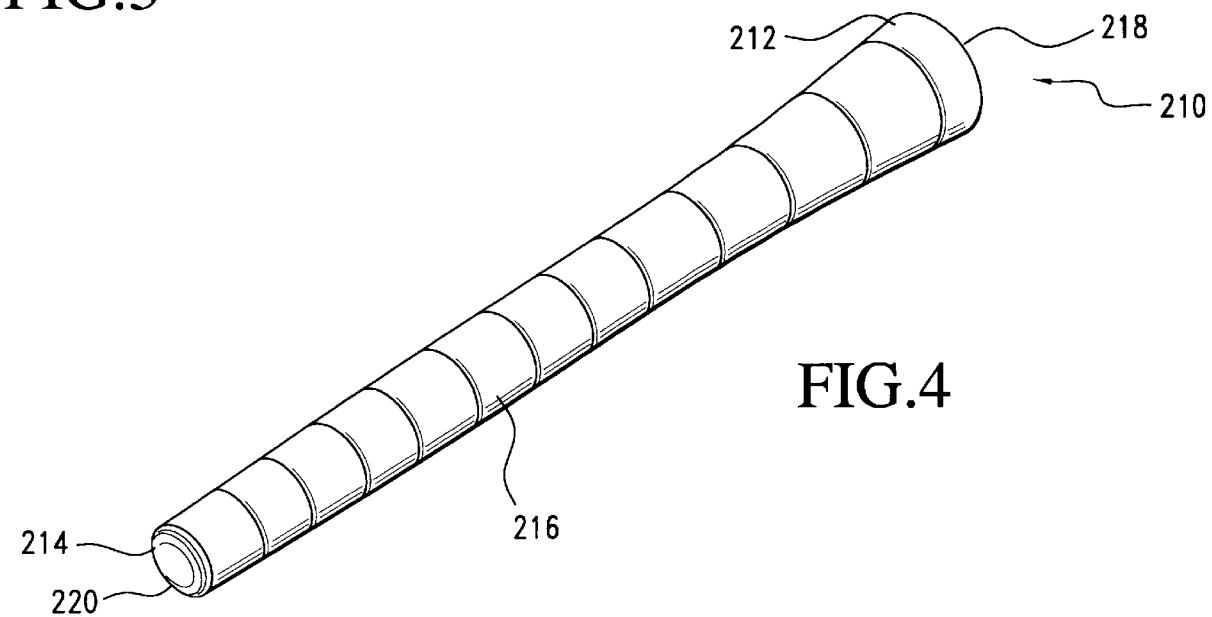
FIG. 4 is a perspective view of a further embodiment in accordance with the present invention.
Figure 5:
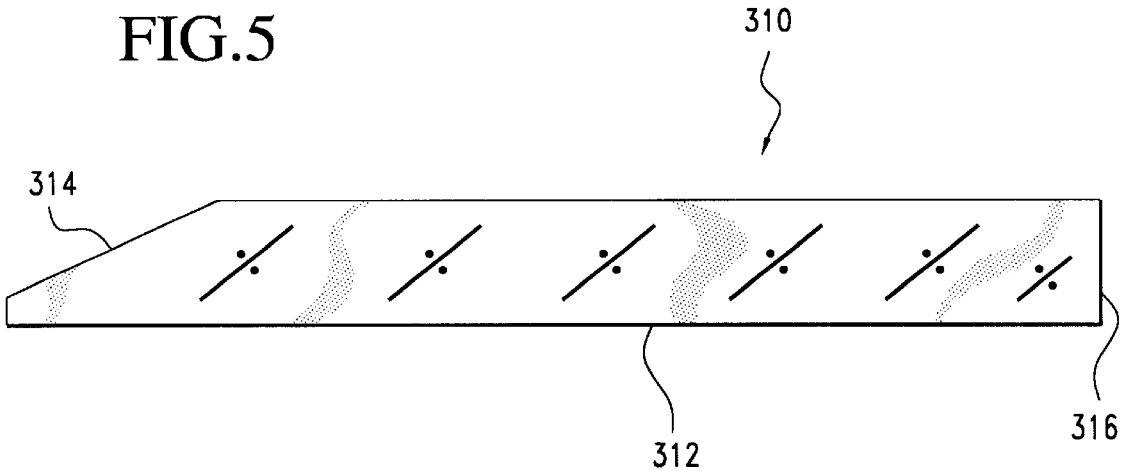
FIG. 5 is a top view of still another embodiment in accordance with the present invention.
Figure 6:
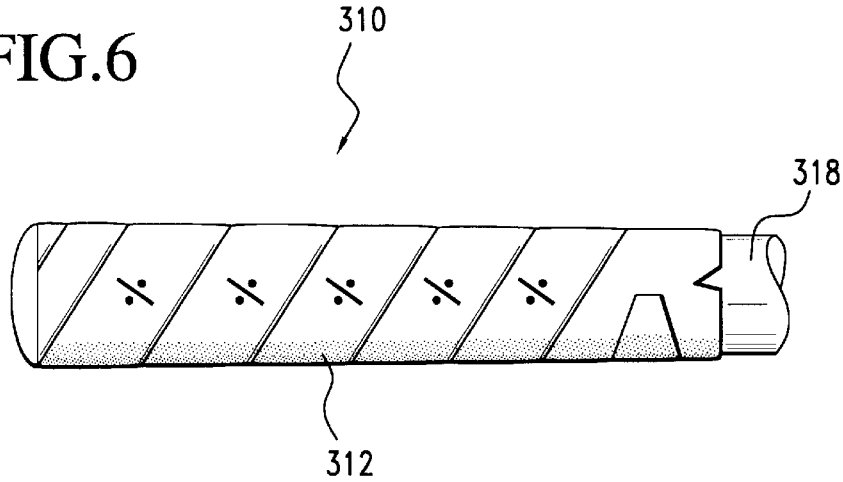
FIG. 6 is a perspective view of the embodiment disclosed in FIG. 5 secured to a golf shaft.

With reference to FIGS. 4 through 6, alternate embodiments for a responsive grip are also contemplated. Specifically, FIG. 4 discloses a one piece grip 210 manufactured exclusively from a viscoelastic solid-phase polymer material. The grip 210 includes a longitudinally extending tubular shell 212 having an inner surface 214 shaped and dimensioned for attachment to a golf club shaft and an outer surface 216 shaped and dimensioned for gripping by an individual. The shell 212 is preferably manufactured from a styrenic thermoplastic elastomer containing, for example, KRATON, manufactured by Shell Chemical Company, although other materials may be used without departing from the spirit of the present invention.

As with the shell discussed above with reference to FIGS. 1–3, the tubular shell 212 shown in FIG. 4 is shaped and dimensioned for use as a golf club grip. With this in mind, the grip is slightly tapered from its closed first end 218 to its open second end 220.

The embodiment disclosed in FIGS. 5 and 6 is a wrap 310 for application to grips. The wrap is a longitudinally extending strip 312 of a viscoelastic solid-phase polymer material having a first end 314 and a second end 316, wherein the first end 314 is cut at an oblique angle to facilitate attachment of the strip 312 to the handle 318 of a sports, or other, implement. The strip 312 is of a length sufficient to be wrapped about the handle 318 and to act as a grip for the implement. The wrap 310 is preferably manufactured from a thermoplastic elastomer, for example, KRATON, manufactured by Shell Chemical, although other materials may be used without departing from the spirit of the present invention. The wrap is, again, composed of the ultra-soft material, which provides unprecedented benefits and advantages to the user.

As shown in FIG. 6, the wrap 310 is secured to the handle 318 of a sports implement, or other implement, by simply encircling the handle in a conventional manner. Additionally, all-purpose adhesive tape or glue may be placed between the handle 318 and the wrap 310 to ensure the secure attachment of the wrap 310 to the handle 318.

It should be appreciated that the styrenic thermoplastic elastomer containing, for example, KRATON, may be altered via chemical and manufacturing processes. This alteration would likely include the softening of the thermoplastic elastomer. Also, other treatments may be used without departing from the spirit of the present invention.

The provision of a responsive viscoelastic polymer hand surface provides golfers with a soft and individually conforming hand surface. In this way, the present grips are designed to enhance the feel of the golf club, and, thereby, improve the golfer's ability to strike a golf ball. A soft grip surface prompts the golfer to use a softer touch in putting and it helps to avoid excessive squeezing on other clubs. The soft viscoelastic hand surface also reduces hand fatigue associated with gripping a hard hand surface. In addition, the use of an elastomeric shell with a responsive viscoelastic polymer material encased therein makes the present golf grip easy to manufacture and place upon the proximal end of a golf club shaft for use by a golfer.

The present grips also provide greater shock absorption and vibration dampening. Clearly, with regard to various sports implements, and other tool and equipment handles, this feature is desirable and helpful to the user. The grips described above provide much more shock absorption than other grips on the market.

In accordance with an alternate embodiment of the disclosed invention, the viscoelastic material may take the form of KEVLAR (manufactured and marketed by the E.I. duPont de Nemours Company), i.e., aramid fibers, introduced into a thermoplastic elastomer, for example, KRATON or ethylene vinyl acetate (EVA).

The introduction of KEVLAR into the soft thermoplastic provides an ideal solution to the shortcomings of prior art thermoplastics. The KEVLAR allows the soft plastic to remain flexible and soft. The KEVLAR is also resistant to liquids and fluids. The introduction of the KEVLAR into the soft thermoplastic provides measurable increases in tear strength, tensile strength, abrasion resistance, and modulus. In summary, the addition of KEVLAR in accordance with the present invention provides sizable increases in material and application strength and life.

In accordance with a preferred embodiment of the present invention, the KEVLAR is fibrillated and chopped prior to its incorporation into a base thermoplastic material. The KEVLAR fibers are then evenly dispersed in chunk/pellet mixture, or form. The pellet or pieces are then mixed, using a twin screw compound extruder, with the soft thermoplastic to create the KEVLAR reinforced viscoelastic compound.

It is contemplated that thermoplastics with KEVLAR in accordance with the present invention will have a Shore A Durometer of approximately 5–60. As such, the plastics are quite soft and flexible. While KRATON and EVA are disclosed in accordance with the preferred embodiment of the present invention, other thermoplastic and/or thermoset materials may be used without departing from the spirit of the invention.

The final KEVLAR reinforced compound is easily processed through injection molding, extrusion or other methods. As such, the KEVLAR reinforced compound may be processed into various shapes and dimensions as required by the specific applications. Although the use of the KEVLAR reinforced compound is not limited to grips per se, it is contemplated that the KEVLAR reinforced compound may be utilized in the manufacture of grips as discussed above.

It is contemplated that the soft and strong combination, which the KEVLAR reinforced material provides, could be useful in various applications where touch and ergonomics are important.

While the preferred embodiments have been shown and described, it will be understood that there is no intent to limit the invention by such disclosure, but rather, is intended to cover all modifications and alternate constructions falling within the spirit and scope of the invention.

What is claimed is:

1. A grip adapted for attachment to an implement including a handle, consisting essentially of:

a longitudinally extending tubular shell including an inner surface shaped and dimensioned for attachment to the handle of the implement and an outer surface shaped and dimensioned to be gripped by an individual, wherein the longitudinally extending tubular shell is made from a viscoelastic solid-phase polymer material composed of fibrillated and chopped aramid fibers dispersed within a thermoplastic elastomer, wherein the thermoplastic elastomer is either a styrenic thermoplastic elastomer or EVA.

2. The grip according to claim 1, wherein the longitudinally extending tubular shell is shaped and dimensioned for use as a golf club grip.

3. The grip according to claim 1, wherein the viscoelastic solid-phase polymer material has a Shore A Durometer of approximately 5 to 60.

4. A grip adapted for attachment to an implement including a handle, comprising:

a longitudinally extending strip of a viscoelastic solid-phase polymer material composed fibrillated and chopped aramid fibers dispersed within a thermoplastic elastomer, wherein the thermoplastic elastomer is either a styrenic thermoplastic elastomer or EVA, the strip having a first end and a second end, wherein the first end is cut at an oblique angle to facilitate attachment of the strip to the handle of the implement;

wherein the strip is of a length sufficient to be wrapped about the handle of the implement to act as a grip for the implement.

5. The grip according to claim 4, wherein the longitudinally extending strip is shaped and dimensioned for use as a golf club grip.

6. The grip according to claim 4, wherein the viscoelastic solid-phase polymer material has a Shore A Durometer of approximately 5 to 60.

7. A grip adapted for attachment to an implement including a handle, comprising:

a longitudinally extending tubular shell including an inner surface shaped and dimensioned for attachment to the handle of the implement and an outer surface; and a hand surface secured about the outer surface of the tubular shell, wherein the hand surface is a solid-phase polymer material composed fibrillated and chopped aramid fibers dispersed within an elastomer, wherein the elastomer is either a styrenic thermoplastic elastomer or EVA.

8. A grip according to claim 7, wherein the tubular shell includes a first end and a second end, and the tubular shell includes an outwardly extending first lip adjacent the first end of the tubular shell and a outwardly extending second lip adjacent the second end of the tubular shell, the first and second lips acting to retain the viscoelastic hand surface in position on the tubular shell.

9. The grip according to claim 7, wherein the longitudinally extending tubular shell is shaped and dimensioned for use as a golf club grip.

10. The grip according to claim 7, wherein the viscoelastic solid-phase polymer material has a Shore A Durometer of approximately 5 to 60.

* * * * *